US005461748A

United States Patent [19]

Koiduka

[11] Patent Number: 5,461,748

[45] Date of Patent: Oct. 31, 1995

[54] MAT, MAT WITH NAME AND METHOD FOR ANCHORING NAME SEAL

[75] Inventor: Tomonari Koiduka, Fukuoka, Japan

[73] Assignee: Houei Co., Ltd., Fukuoka, Japan

[21] Appl. No.: 173,093

[22] Filed: Dec. 27, 1993

[30] Foreign Application Priority Data

Aug. 30, 1993 [JP] Japan ..... 5-239103

[51] Int. Cl.[6] ..... A47L 23/26; A47L 23/22

[52] U.S. Cl. ..... 15/161; 15/215; 15/217; 52/181; 428/67

[58] Field of Search ..... 15/161, 215, 216, 15/217, 238; 52/105, 177, 181; 428/67; 152/524, 525

[56] References Cited

U.S. PATENT DOCUMENTS

| | | | |
|---|---|---|---|
| 2,225,107 | 12/1940 | Galkin | 15/216 |
| 2,875,541 | 3/1959 | Lefcourt | 15/238 |
| 3,696,459 | 10/1972 | Kucera | 15/217 |
| 3,930,084 | 12/1975 | Shields | 428/67 |
| 4,109,439 | 8/1978 | Feasel | 15/215 |
| 4,318,436 | 3/1982 | Shurman | 152/525 |
| 4,361,925 | 12/1982 | Yamamoto | 15/217 |
| 4,401,145 | 8/1983 | Hausch | 152/525 |
| 4,830,892 | 5/1989 | Nussbaum | 428/67 |
| 4,879,151 | 11/1989 | Ellington, Jr. | 52/181 |
| 5,108,094 | 4/1992 | Quinn | 52/177 |
| 5,364,688 | 11/1994 | Mahn, Jr. | 152/524 |

FOREIGN PATENT DOCUMENTS

| | | | |
|---|---|---|---|
| 6536 | 12/1927 | Australia | 15/238 |
| 99189 | 9/1924 | Austria | 15/215 |
| 0212538 | 3/1987 | European Pat. Off. | 152/524 |
| 318311 | 6/1934 | Italy | 15/238 |
| 0119964 | 10/1978 | Japan | 15/238 |
| 0857393 | 8/1981 | U.S.S.R. | 52/177 |
| 937114 | 9/1963 | United Kingdom | 15/217 |

*Primary Examiner*—Timothy F. Simone
*Assistant Examiner*—Randall E. Chin
*Attorney, Agent, or Firm*—Flynn, Thiel, Boutell & Tanis

[57] ABSTRACT

A mat in which an element of thermoplastic resin as the base material for anchoring a name is integrated with a mat main body so as to be exposed on the surface of the mat main body. A name seal is welded on the surface of the element of thermoplastic resin. The name seal is made out of thermoplastic resin and may have coloring and design which does not impede the name display.

8 Claims, 2 Drawing Sheets

MAT, MAT WITH NAME AND METHOD FOR ANCHORING NAME SEAL

DESCRIPTION OF INVENTION

Mat, mat with name and Method for anchoring name seal

BACKGROUND OF THE INVENTION (1) Field of the Invention

The present invention relates to a mat for removing mud and dirt sticking to footwear of a person who comes in from outside of a room or from the outdoors. The present invention relates particularly to a mat or a mat with name seal and a method for anchoring a name on a mat that is suitable for rental.

(2) Brief Description of the Prior Art

It is conventional for a rental mat spread used, for removing mud and dirt from footwear, to have anchored thereon, a name of a rental dealer.

Such a mat is cured after packing planting material to a mat main body formed with raw rubber. However, a plastic name seal can no longer be firmly fixed on the mat main body, hardened through the process of curing, even if adhesives and welding are used because the rubber to be joined does not melt or flow if reheated.

Therefore, when the name seal is fixed on the mat main body, a method is adopted wherein the name seal is anchored so as to cut into the mat main body by simultaneously press sticking the name seal and the planting material into the material of mat main body.

However, in the method in which the name seal and planting material are simultaneously pressed into the conventional material of a mat main body, that is, the name seal is anchored when the mat is manufactured, the mat can not be manufactured for the general run of demand because the work can not be started until the order is decided from customers desiring to anchor their name. Therefore, it is very difficult to secure a proper stock, and an inefficient customization system is the result.

The fault mentioned above causes delay of delivery time to occur in customization as well as obstructing the level of production and increases the cost of production.

SUMMARY OF THE INVENTION

The present invention is intended to solve the conventional problems, and the object is to provide a mat, a mat with name and a method for anchoring a name seal, wherein it is possible to maintain a proper stock of mats for the general run of customers wherein, the specified name of a customer can be easily and firmly anchored at any time at any geographic location, and the mat can be delivered on time.

For achieving the object mentioned above, an element of thermoplastic resin as a base material for anchoring the name is integrated with the mat main body formed by curing raw rubber. In this case, an element of thermoplastic resin used for the base material for anchoring the name includes coloring and design, which do not impede name display, being applied.

For a mat with name, a mat integrated with an element of thermoplastic resin for the base material for anchoring the name on the mat main body formed by curing raw rubber is used, and a thermoplastic resin seal with name is adhered on the element of thermoplastic resin of the mat main body.

In the method for anchoring the name seal, the material of the mat main body, formed from raw rubber, is packed with planting material, the mat having a planting portion and the element of thermoplastic resin on the mat main body is formed by curing the material of the mat main body after pressing thermoplastic resin onto the material of the mat main body, then, the thermoplastic resin seal with name is adhered on the element of thermoplastic resin of the mat main body.

DETAILED DESCRIPTION OF THE PRESENT INVENTION

Figure 1:
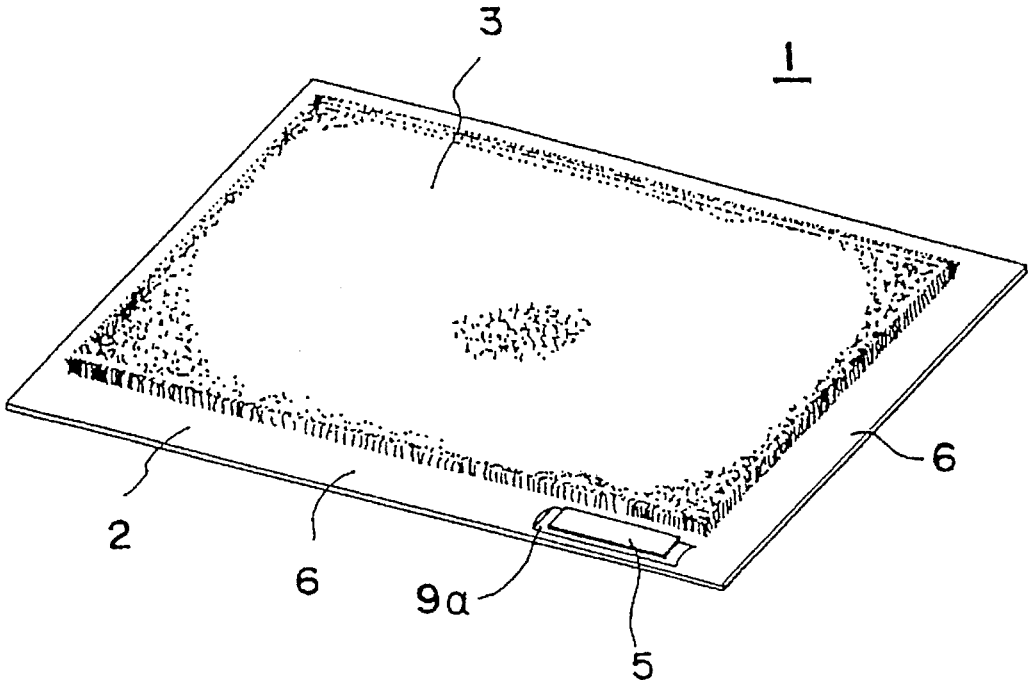
FIG. 1 is a perspective drawing for showing a mat with name.
Figure 2B:
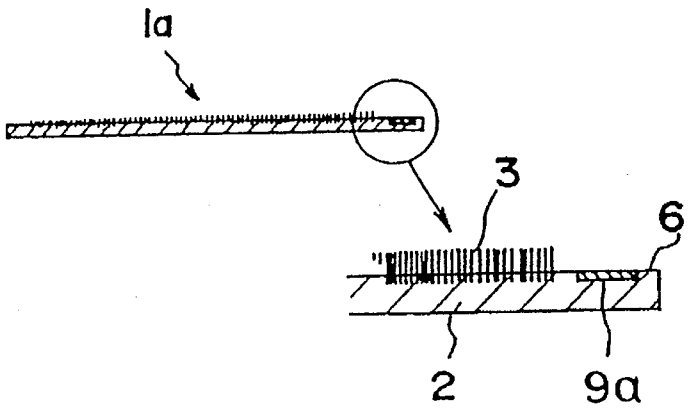
FIG. 2 is a drawing for showing the process of anchoring the name on a mat.
Figure 2D:
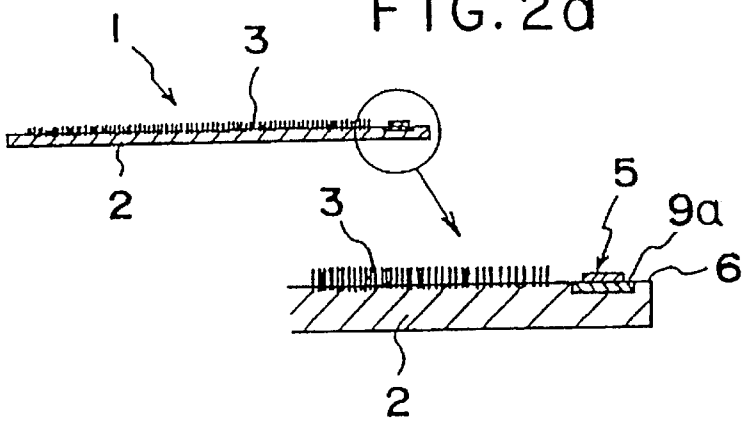
Figure 2A:
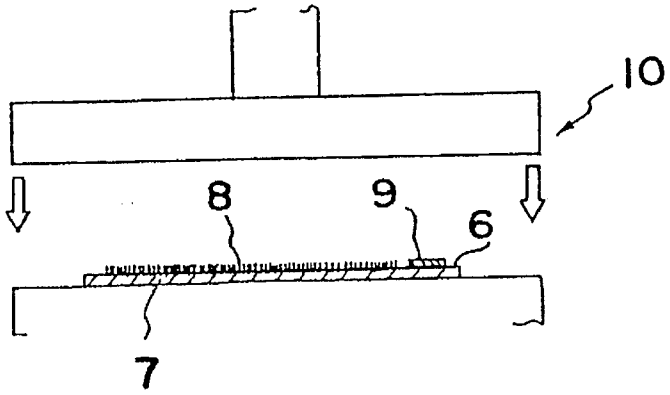
Figure 2C:
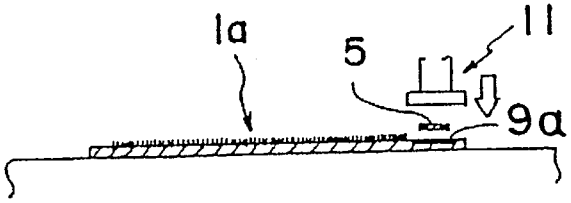

A mat with name 1 is mainly composed of a mat main body 2, a planting portion 3, an element of thermoplastic resin 4 and a thermoplastic resin seal with name 5.

The mat 1 is, as shown in FIG. 1, formed in which the mat main body 2 is formed in a sheet shape by curing raw rubber, and the planting portion 3 formed into a brush shape with nylon fibers is fixed on the whole surface with an edge portion 6 left.

Further, the element of thermoplastic resin 9*a* is integrated with the mat main body 2 so as to be exposed on the surface of the mat main body 2 at one end of the edge portion 6, and the thermoplastic resin seal 5 is adhered thereon so as to be integrated therewith. In this case, the thermoplastic resin seal 5 can be a transparent seal with name.

The method for anchoring the name on the mat with name 1 will be explained as follows.

In a first step, a sheet-like material of mat main body 7 is formed with raw rubber in which curing material has been added. Then after, as shown in FIG. 2 (*a*), a planting material 8 is placed on the material of mat main body 7 inward from the outer perimeter of the mat main body so as to define an edge portion 6 around the outer perimeter of the mat main body. Then, the main body 7 is compressed by a press machine 10 after an element made of polyvinyl chloride 9 is placed on top of one end of the edge portion 6.

By this first step, the lower portion of the planting material 8 and a polyvinyl chloride element 9 is laid on the material of the mat main body 7 for its thickness. Since the material of mat main body 7 is cured and hardened in this state, as shown in FIG. 2 (*b*), the mat 1*a*, with an element of thermoplastic resin 9*a* is exposed on the edge portion 6 of the mat main body 2 can be prepared by putting the planting portion 3 on the mat main body 2 and fixing the polyvinyl chloride element 9 atop one end of the edge portion 6 of the mat main body 2 so that the element 9 and planting portion 3 become integrated with the mat main body 2. The mat 1*a* is stocked in this state.

When the mat with name 1 is required, as a second step, the mat 1 a described above is used. In this case, as shown in FIG. 2 (*c*), the mat la is placed on a workbench or a desk, and a thermoplastic resin seal with specified name made of polyvinyl chloride 5 is placed on the surface of thermoplastic resin 9*a*. The thermoplastic resin seal with specified name 5 is firmly welded onto the surface of the thermoplastic resin 9*a* of the mat main body 2 to provide the mat with a name by directing onto the seal, a high frequency from a high frequency welder 11 from above.

As the explanation described above, in this embodiment, the element of thermoplastic resin 9*a* can be integrated with the edge portion 6 of the mat main body 2 at the same time that the planting portion 3 is integrated with the mat main body 2. In this step, since the mat 1*a* does not have any name anchored thereon, it can be maintained in a generalized proper stock for the general run of demand.

When mats with a specified name are required, the number of required mats is drawn out from the stock, and the mat with specified name is provided by a simple process using a simple welding machine in a short of time period. Accordingly, delay of the delivery does not occur, so that the mat with specified name can be delivered on time.

Moreover, anchoring the name can be performed by anyone if there is a simple welding machine, so the mat can be stocked dispersedly in offices not equipped with a large-scaled curing device. Further, the cost of production can also be reduced because a proper stock is possible.

The concrete structure of the present invention is not limited to the embodiment mentioned above, concrete design change is included in the present invention.

For example, in an embodiment, polyvinyl chloride is reused for the element of thermoplastic resin 9*a* and thermoplastic resin seal 5, but the type of material can be set at will.

Also, the element of thermoplastic resin 9*a* can be provided at the same level of the surface of the mat main body 2, and also can be provided so as to protrude from the surface of the mat main body or to cave therefrom.

The process of anchoring the name can be performed by the user side as well as the manufacturer side.

A heater, a hair drier and a steam heater can be used as a welding machine.

As explained above, in the mat, the proper stock can be provided to the general run of demand in the state where the mat is usable before anchoring the name, and thereby, the effect of reducing of the cost of production can be obtained.

In a mat with name, as the structure mentioned above, the number of mats required be drawn without the name anchored thereon, and the thermoplastic resin seal with specified name is stuck on the surface of thermoplastic resin element of the mat main body. With these procedures, the mat with specified name of the customer can be prepared and delivered on time.

In the method for anchoring the name on the mat, as adopted in the above-mentioned method, in the first step, the mat, wherein the surface of thermoplastic resin is formed on the mat main body, is provided. In this state, since the name is not anchored on the mat, distribution is possible to any customer. Thereby, a general stock can be stored for the general run of customers. Thus, an order can be accepted at any time, and the cost of production can be reduced.

In the second step, when a mat is required, the mat with specified name is prepared after anchoring the name of the customer in the number of required mats. In this case, because the thermoplastic resin seal with name is adhered to the surface of thermoplastic resin element of the mat main body, the name can be firmly anchored in a short-period by the simple procedure with a simple welding machine. Accordingly, the mat with specified name can be delivered without delay.

What is claimed is:

1. A mat adapted for cleaning the soles of shoes of a wearer comprising:

a cured rubber mat main body having a nylon fiber planting portion and an edge portion, said mat main body and edge portion each having an upper surface;

an element of thermoplastic resin attached to said edge portion of said mat main body and said element being flush with said upper surface of said mat edge portion; and a thermoplastic name seal welded on said element of thermoplastic resin.

2. The mat of claim 1, wherein said mat main body is formed with an outer perimeter and, said nylon fiber planting portion is spaced inward from said outer perimeter of said mat main body so as to define said main body edge portion adjacent said mat main body perimeter.

3. The mat of claim 2, wherein said mat main body has a generally rectangular profile.

4. The mat of claim 1, wherein said mat main body has a generally rectangular profile.

5. A mat comprising:

a cured rubber mat main body, said mat main body having an upper surface; and a thermoplastic resin element attached to said mat main body wherein said thermoplastic resin element is formed with an upper surface adapted for anchoring a name seal thereon and said thermoplastic resin element is attached to said mat main body so that said entire upper surface of said thermoplastic resin element is flush with said upper surface of said mat main body.

6. The mat of claim 5, further including a plurality of nylon fibers attached to said mat main body so as to extend upward above the upper surface of said mat main body.

7. The mat of claim 6, wherein said mat is formed to define an outer perimeter; said nylon fibers are located inward from said outer perimeter of said mat main body so as to define an edge portion of said mat adjacent said outer perimeter that is free of said nylon fibers; and said thermoplastic resin element is attached to said edge portion of said mat main body.

8. The mat of claim 7, wherein said mat main body is formed to have a generally rectangular shape.

* * * * *